US005802746A

United States Patent [19]

Miller

[11] Patent Number: 5,802,746

[45] Date of Patent: Sep. 8, 1998

[54] VEHICLE-MOUNTED SNOW PLOWING SYSTEM

[76] Inventor: David L. Miller, 17286 460th Ave., Watertown, S. Dak. 57201

[21] Appl. No.: 839,951

[22] Filed: Apr. 24, 1997

[51] Int. Cl.[6] ..... E01H 5/04

[52] U.S. Cl. ..... 37/263; 37/232; 172/833

[58] Field of Search ..... 37/263, 232, 233, 37/231, 266, 272, 273, 274, 283; 172/833

[56] References Cited

U.S. PATENT DOCUMENTS

| | | | |
|---|---|---|---|
| 1,199,075 | 9/1916 | Hyde | 37/263 X |
| 1,262,966 | 4/1918 | Mohan | 37/263 |
| 1,498,690 | 6/1924 | Hunziker | 37/263 |
| 1,506,634 | 8/1924 | Hartshorn | 37/263 X |
| 1,744,801 | 1/1930 | Rimple et al. | 37/263 X |
| 1,749,465 | 3/1930 | Caskin | 37/263 X |
| 1,805,933 | 5/1931 | Victor | 37/263 X |
| 2,282,367 | 5/1942 | Koistinen | 172/833 X |
| 2,582,136 | 1/1952 | Koblas | 37/263 |
| 2,623,310 | 12/1952 | Raught | 172/833 X |
| 2,722,064 | 11/1955 | Jaff et al. | 37/263 X |
| 2,889,640 | 6/1959 | Endres | 37/263 |
| 2,955,367 | 10/1960 | Vort | 37/263 |
| 2,970,392 | 2/1961 | Perkins et al. | 37/272 X |
| 3,214,894 | 11/1965 | Whitman | 172/833 X |
| 3,831,689 | 8/1974 | Smith | 37/232 X |
| 4,145,825 | 3/1979 | Bertolino . | |
| 4,450,635 | 5/1984 | Shwayder . | |
| 4,570,366 | 2/1986 | Yost . | |
| 4,597,202 | 7/1986 | Weeks . | |
| 4,794,710 | 1/1989 | Haring . | |
| 5,191,729 | 3/1993 | Verseef | 37/232 |
| 5,353,530 | 10/1994 | Pieper . | |

*Primary Examiner*—Tamara L. Graysay
*Assistant Examiner*—Thomas A. Beach

[57] ABSTRACT

A new Vehicle-Mounted Snow Plowing System for improving the driveability of a vehicle in snow by clearing snow away from the intended path of the wheels of the vehicle. The inventive device includes a vehicle mount removably mounted to the front of a vehicle, and a pair of snow deflector assemblies removably mounted to the vehicle mount. The snow deflector assemblies are mounted ahead of and in line with the front wheels of the vehicle. Furthermore, the snow deflector assemblies are moveable between a lowered, operative position and a raised, stowed position.

18 Claims, 4 Drawing Sheets

VEHICLE-MOUNTED SNOW PLOWING SYSTEM

BACKGROUND OF THE INVENTION

1. Field of the Invention

The present invention relates to snow plows and more particularly pertains to a new Vehicle-Mounted Snow Plowing System for improving the driveability of a vehicle in snow by clearing snow away from the intended path of the wheels of the vehicle.

2. Description of the Prior Art

The use of snow plows is known in the prior art. More specifically, snow plows heretofore devised and utilized are known to consist basically of familiar, expected and obvious structural configurations, notwithstanding the myriad of designs encompassed by the crowded prior art which have been developed for the fulfillment of countless objectives and requirements.

Known prior art snow plows include U.S. Pat. No. 4,145,825; U.S. Pat. No. 4,794,710; U.S. Pat. No. 4,570,366; U.S. Pat. No. 5,353,530; U.S. Pat. No. 4,450,635; and U.S. Pat. No. 4,597,202.

While these devices fulfill their respective, particular objectives and requirements, the aforementioned patents do not disclose a new Vehicle-Mounted Snow Plowing System. The inventive device includes a vehicle mount removably mounted to the front of a vehicle, and a pair of snow deflector assemblies removably mounted to the vehicle mount. The snow deflector assemblies are mounted ahead of and in line with the front wheels of the vehicle. Furthermore, the snow deflector assemblies are moveable between a lowered, operative position and a raised, stowed position.

In these respects, the Vehicle-Mounted Snow Plowing System according to the present invention substantially departs from the conventional concepts and designs of the prior art, and in so doing provides an apparatus primarily developed for the purpose of improving the driveability of a vehicle in snow by clearing snow away from the intended path of the wheels of the vehicle.

SUMMARY OF THE INVENTION

In view of the foregoing disadvantages inherent in the known types of snow plows now present in the prior art, the present invention provides a new Vehicle-Mounted Snow Plowing System construction wherein the same can be utilized for improving the driveability of a vehicle in snow by clearing snow away from the intended path of the wheels of the vehicle.

The general purpose of the present invention, which will be described subsequently in greater detail, is to provide a new Vehicle-Mounted Snow Plowing System apparatus and method which has many of the advantages of the snow plows mentioned heretofore and many novel features that result in a new Vehicle-Mounted Snow Plowing System which is not anticipated, rendered obvious, suggested, or even implied by any of the prior art snow plows, either alone or in any combination thereof.

To attain this, the present invention generally comprises a vehicle mount removably mounted to the front of a vehicle, and a pair of snow deflector assemblies removably mounted to the vehicle mount. The snow deflector assemblies are mounted ahead of and in line with the front wheels of the vehicle. Furthermore, the snow deflector assemblies are moveable between a lowered, operative position and a raised, stowed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Vehicle-Mounted Snow Plowing System apparatus and method which has many of the advantages of the snow plows mentioned heretofore and many novel features that result in a new Vehicle-Mounted Snow Plowing System which is not anticipated, rendered obvious, suggested, or even implied by any of the prior art snow plows, either alone or in any combination thereof.

It is another object of the present invention to provide a new Vehicle-Mounted Snow Plowing System which may be easily and efficiently manufactured and marketed.

It is a further object of the present invention to provide a new Vehicle-Mounted Snow Plowing System which is of a durable and reliable construction.

An even further object of the present invention is to provide a new Vehicle-Mounted Snow Plowing System which is susceptible of a low cost of manufacture with regard to both materials and labor, and which accordingly is then susceptible of low prices of sale to the consuming public, thereby making such Vehicle-Mounted Snow Plowing System economically available to the buying public.

Still yet another object of the present invention is to provide a new Vehicle-Mounted Snow Plowing System which provides in the apparatuses and methods of the prior art some of the advantages thereof, while simultaneously overcoming some of the disadvantages normally associated therewith.

Still another object of the present invention is to provide a new Vehicle-Mounted Snow Plowing System for improving the driveability of a vehicle in snow by clearing snow away from the intended path of the wheels of the vehicle.

Furthermore, while driving in snow, snow will often buildup in front of and underneath the front of the vehicle. When this occurs, the vehicle may loose traction and, in some instances, become stuck. If the vehicle should become stuck, a person may attempt to back out of the area. To do so, however, a person must often physically remove snow that may have built-up behind the wheels of the vehicle. Accordingly, the present invention also creates a clear path for the wheels of the vehicle to travel through while backing out. Thus, the present invention eliminates the need to physically remove snow from behind the wheels of the vehicle during an attempt to free the vehicle by backing up, if the vehicle should become stuck.

Yet another object of the present invention is to provide a new Vehicle-Mounted Snow Plowing System which includes a vehicle mount removably mounted to the front of a vehicle, and a pair of snow deflector assemblies removably mounted to the vehicle mount. The snow deflector assemblies are mounted ahead of and in line with the front wheels of the vehicle. Furthermore, the snow deflector assemblies are moveable between a lowered, operative position and a raised, stowed position.

Still yet another object of the present invention is to provide a new Vehicle-Mounted Snow Plowing System that reduces drag and wheel spin by clearing snow away from the intended path of the wheels of the vehicle. Often, even a small amount of snow can cause the wheels of a vehicle to loose traction. Thus, causing the vehicle to shift from side-to-side and creating a dangerous driving situation. This problem is exacerbated by drifted snow which has a tendency to pull a vehicle in one direction. Accordingly, the present invention allows a driver to plow through snow, including drifted snow, while maintaining complete control of the vehicle.

Even still another object of the present invention is to provide a new Vehicle-Mounted Snow Plowing System that may be easily removed from and installed on a vehicle. Accordingly, the present invention uses a simple bolt-on mounting system. As such, with many types of vehicles, existing bolt holes may be utilized while mounting the present invention on the vehicle. With some vehicles, however, a minimal amount of drilling, albeit in easily accessible areas of the frame of the vehicle, is required to mount the present invention on the vehicle.

Even still another object of the present invention is to provide a new Vehicle-Mounted Snow Plowing System that is easily movable between a raised, stowed position and a lowered, operative position. Thus, the present invention may remain installed on a vehicle all winter long and may be moved to the lowered, operative position when necessary. This is an important feature since winter driving conditions can change very rapidly.

Even still another object of the present invention is to provide a new Vehicle-Mounted Snow Plowing System that clears snow while allowing other rigid obstacles to pass underneath. Furthermore, when driving in reverse, the present invention pivots forward if a rigid obstacle is encountered.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
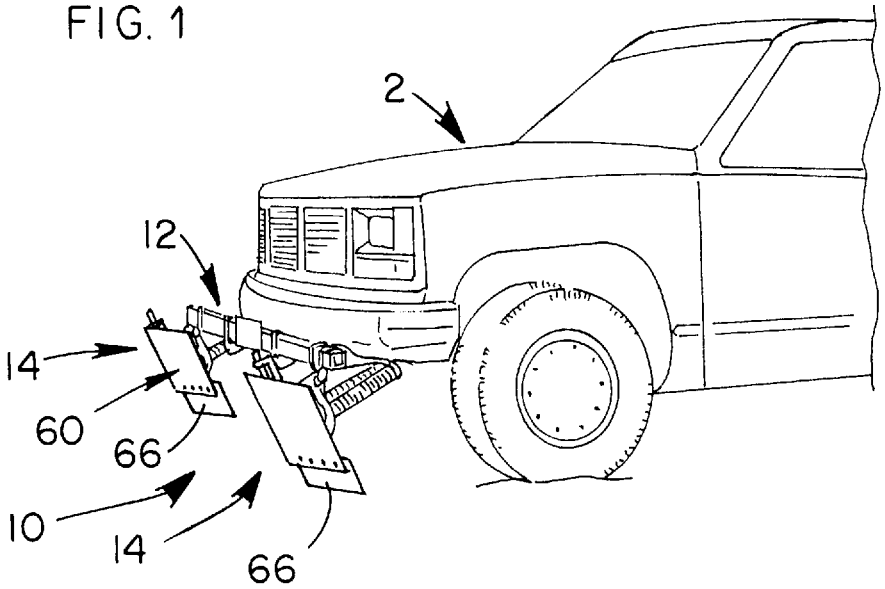
FIG. 1 is a isometric illustration of the present invention installed on a vehicle and in a lowered, operative position.

With reference now to the drawings, and in particular to FIGS. 1 through 6 thereof, a new Vehicle-Mounted Snow Plowing System embodying the principles and concepts of the present invention and generally designated by the reference numeral 10 will be described.

As best illustrated in FIGS. 1 through 6, the Vehicle-Mounted Snow Plowing System 10 comprises a vehicle mount 12 removably mounted to the front of a vehicle 2, and a pair of snow deflector assemblies 14 removably mounted to the vehicle mount 12. The snow deflector assemblies 14 are mounted ahead of and in line with the front wheels of the vehicle 2. Furthermore, the snow deflector assemblies 14 are moveable between a lowered, operative position and a raised, stowed position.

Figure 3:
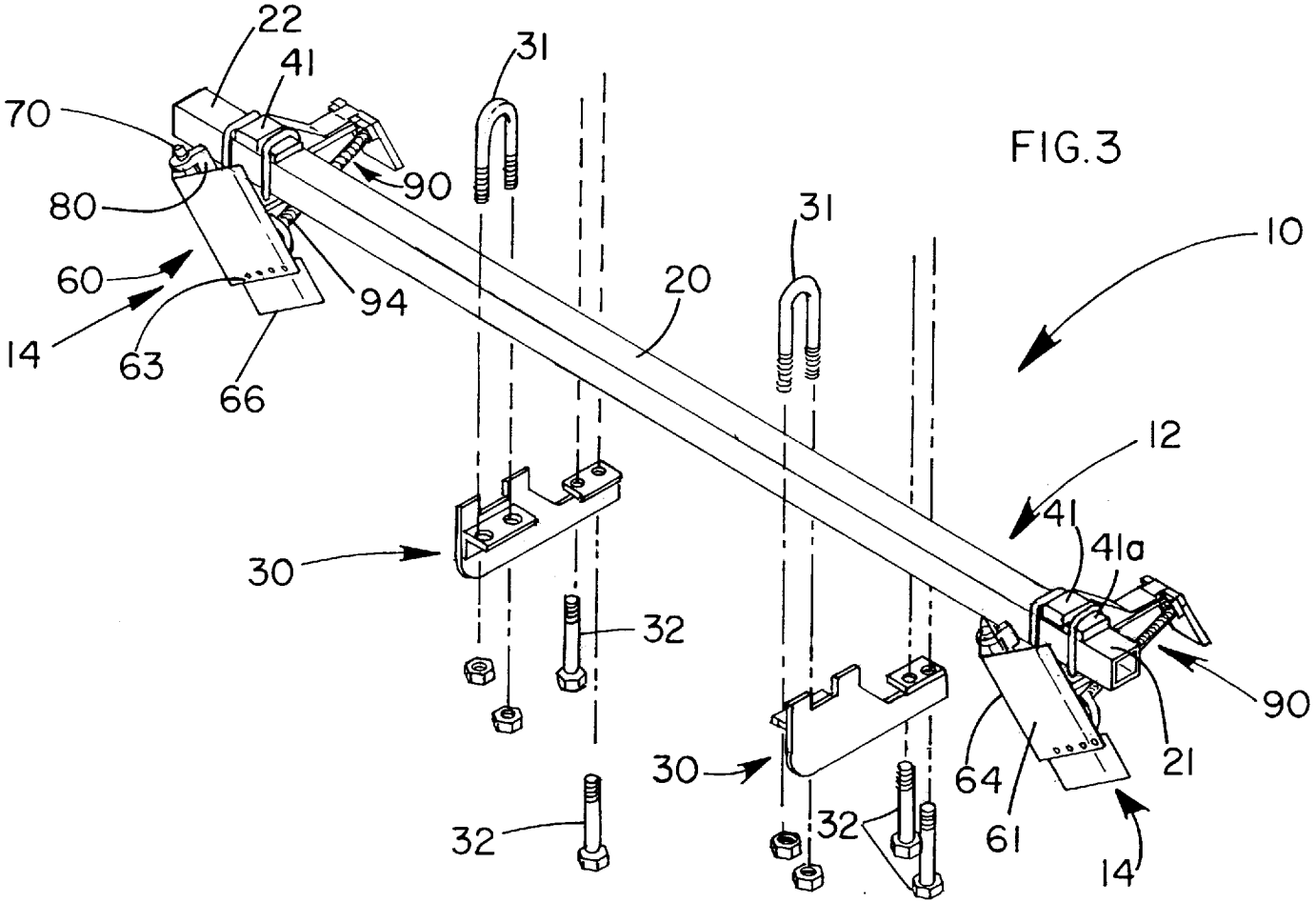
FIG. 3 is an exploded isometric illustration of the vehicle mount of the present invention.

As best illustrated in FIG. 3, the vehicle mount 12 comprises an elongated member 20, and a pair of spaced mounting brackets 30 each secured to the elongated member 20 wherein the pair of spaced mounting brackets 30 are each mounted to the front of the vehicle 2. The elongated member 20 has a first end 21 and a second end 22 and is sufficiently long so as to generally traverse the front of the vehicle 2. Each of the mounting brackets 30 are secured to the elongated member 20 by a U-bolt 31 and are mounted to the underside of the front of the vehicle 2 by bolts 32. Preferably, the mounting brackets 30 are mounted to the frame or the bumper mounts of the vehicle 2. In the preferred embodiment, the elongated member 20 is formed of square tubular steel.

Figure 2:
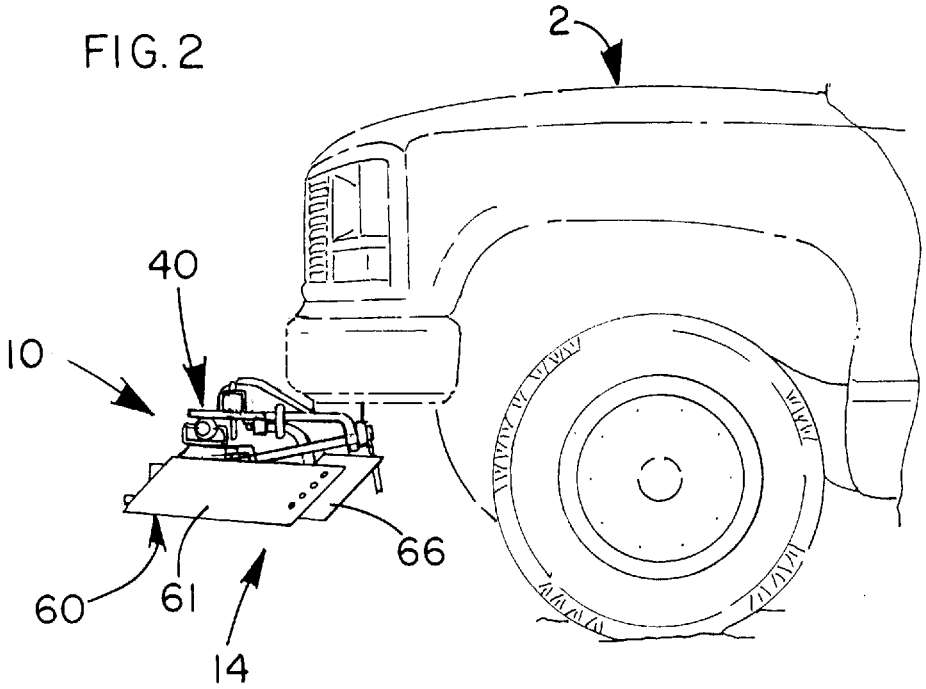
FIG. 2 is a side view of the present invention installed on a vehicle and in a raised, stowed position.

As best illustrated in FIGS. 1 and 2, a first of the snow deflector assemblies 14 is removably mounted to the elongated member 20 adjacent the first end 21 thereof and a second of the snow deflector assemblies 14 is removably mounted to the elongated member 20 adjacent the second end 22 thereof. In the lowered, operative position the snow deflector assemblies 14 are generally vertically oriented and in the raised, stowed position the snow deflector assemblies 14 are generally horizontally oriented.

Figure 4:
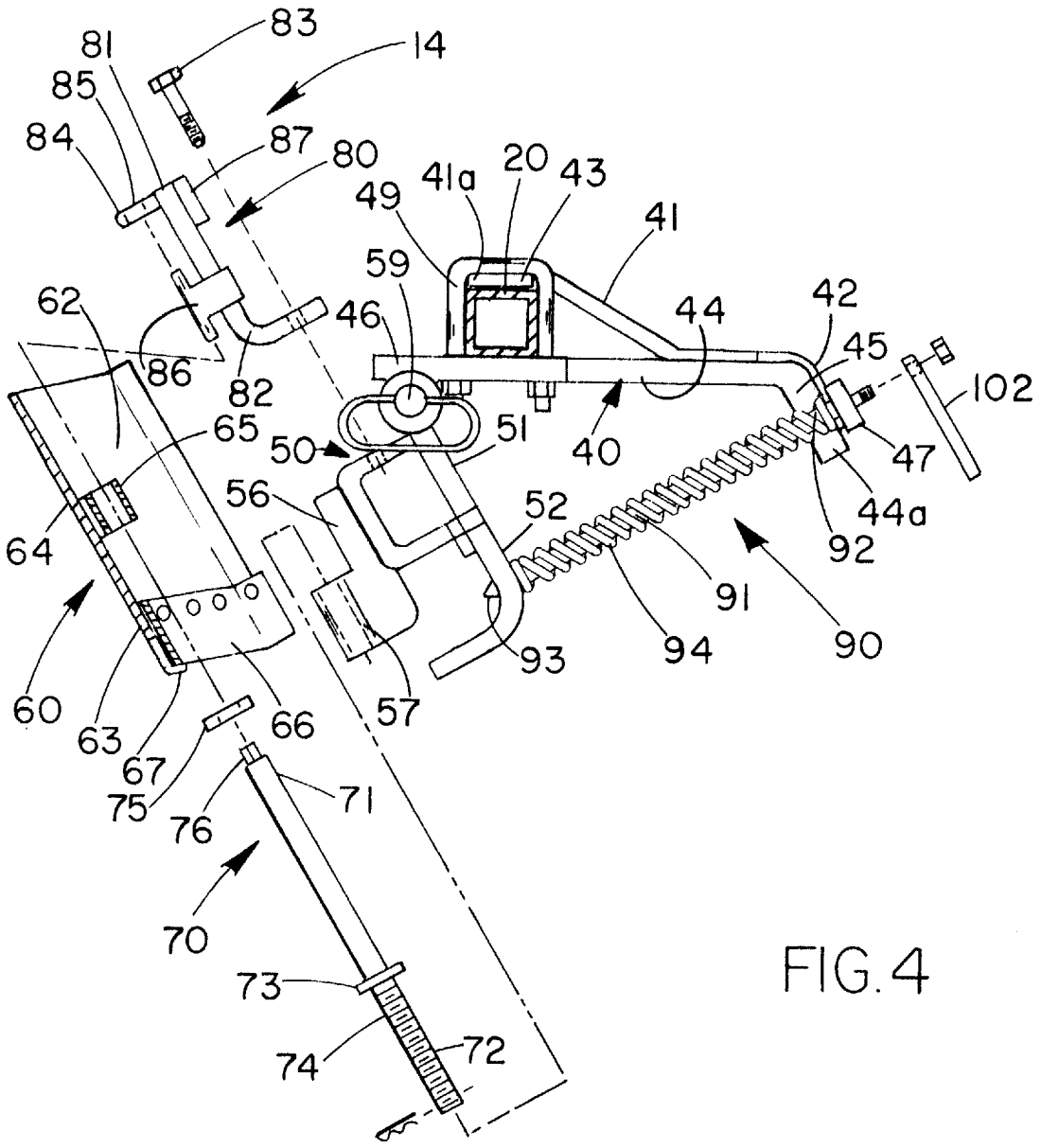
FIG. 4 is an exploded side view of a snow deflector assembly of the present invention.
Figures 5, 6:
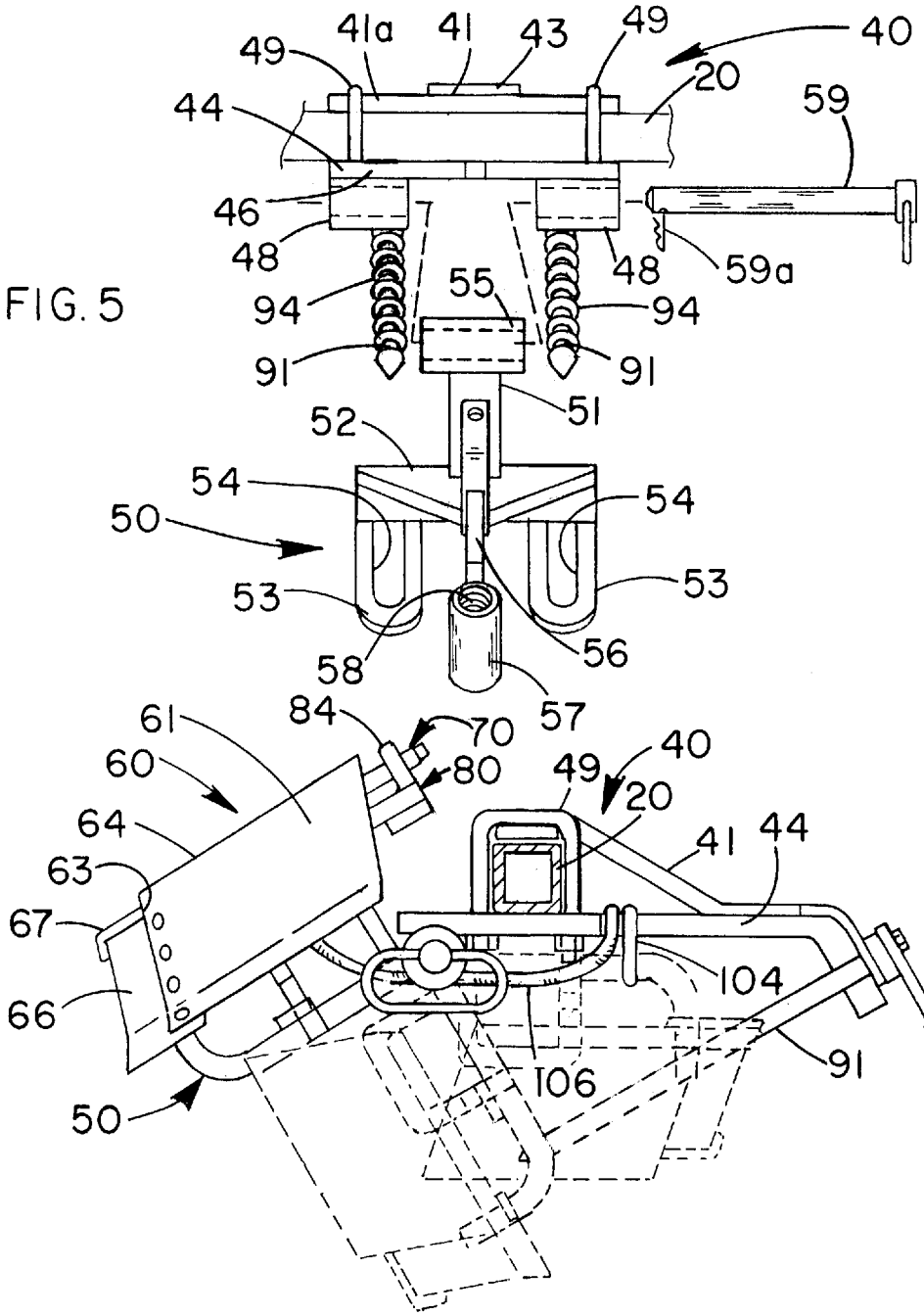
FIG. 5 is a front view of the mounting frame and the lower carriage of the snow deflector assembly of the present invention.
FIG. 6 is a side view of the snow deflector assembly pivoting between the raised, stowed position, the lowered, operative position and a forward position.

As best illustrated in FIGS. 4 and 5, each of the pair of snow deflector assemblies 14 comprises a mounting frame 40 removably secured to the elongated member 20 of the vehicle mount 12, a lower carriage 50 coupled to the mounting frame 40, and a snowplow blade 60 coupled to the lower carriage 50.

The mounting frame 40 includes an upper plate 41 and a lower plate 44. The upper plate 41 and the lower plate 44 each have a first end 42 and 45, respectively, and a second end 43 and 46, respectively. The upper plate 41 and the lower plate 44 are joined at the first ends 42 and 45 thereof. The upper plate 41 diverges from the lower plate 44 towards the second end 43 of the upper plate 41. Furthermore, the upper plate 41 terminates with a T-shaped portion 41*a* at the second end 43 thereof. As such, the elongated member 20 of the vehicle mount 12 may be positioned between the T-shaped portion 41*a* of the upper plate 41 and the lower plate 44. The mounting frame 40 is secured to the elongated member 20 by U-bolts 49.

The lower plate 44 of the mounting frame 40 includes an angled portion 44*a* at the first end 45 thereof wherein the angled portion 44*a* extends generally downward. The mounting frame 40 includes a mounting plate 47 secured to the angled portion 44*a* of the lower plate 44. A flap 102 is secured to the mounting plate 47. The flap 102 helps to reduce the build-up of snow behind the snowplow blade 60.

The mounting frame 40 also includes a pair of aligned sleeves 48 each having a bore therethrough. The pair of aligned sleeves 48 are provided adjacent the second end 46 of the lower plate 44. The pair of aligned sleeves 48 are horizontally oriented and are secured to the lower plate 44 in spaced relation.

The lower carriage 50 has an upper end 51 and a lower end 52 and includes a pair of spaced legs 53 extending from the lower end 52 thereof. Each of the spaced legs 53 have a slot 54 therein and have a generally arcuate shape. The lower carriage 50 also includes an upper sleeve 55 at the upper end 51 thereof. The upper sleeve 55 is horizontally oriented and has a bore therethrough. The lower carriage 50 includes an arm 56 extending outward therefrom and includes a lower sleeve 57 at an outermost end of the arm 56. The lower sleeve 57 is vertically oriented and has a bore therethrough. In addition, the bore of the lower sleeve 57 includes internal threads 58.

The lower carriage 50 is pivotally coupled to the mounting frame 40 by a pivot pin 59. As such, the pivot pin 59 is horizontally inserted through a first of the pair of aligned sleeves 48 of the mounting frame 40, through the upper sleeve 55 of the lower carriage 50, and through a second of the pair of aligned sleeves 48 of the mounting frame 40. A cotter pin 59*a* retains the pivot pin 59 in position.

The snowplow blade 60 is generally V-shaped or chevron-shaped. The snowplow blade 60 has a front face 61, a rear face 62, a lower edge 63, and a leading edge 64. The snowplow blade 60 includes a sleeve 65 secured to the rear face 62 thereof. The snowplow blade 60 is formed of steel and includes a rubber pad 66 along the lower edge 63 thereof. An L-shaped rod 67 extends downward from the lower edge 63 of the snowplow blade 60 at the leading edge 64 thereof. One leg of the L-shaped rod 67 extends along and in front of the rubber pad 66 and the other leg extends under the rubber pad 66. As such, the ground is contacted by the L-shaped rod 67 and the rubber pad 66 rather than the lower edge 63 of the snowplow blade 60. Accordingly, the rubber pad 66 serves as a cushioning and sound damping member when the snowplow blade 60 contacts the ground. In addition, the rubber pad 66 may be easily replaced when it becomes worn.

The snowplow blade 60 is pivotally coupled to the lower carriage 50 by a shaft 70. The shaft 70 has an upper end 71 and a lower end 72. The shaft 70 includes a collar 73 intermediate the upper end 71 and the lower end 72 and includes external threads 74 adjacent the lower end 72 thereof. Accordingly, the upper end 71 of the shaft 70 is inserted through the sleeve 65 of the snowplow blade 60 and the lower end 72 of the shaft 70 is threadingly inserted into the lower sleeve 57 of the lower carriage 50. A damping disc 75 is interposed between the collar 73 of the shaft 70 and the sleeve 65 of the snowplow blade 60.

Each of the snow deflector assemblies 14 also includes an upper carriage 80 secured to the lower carriage 50. The upper carriage 80 has an upper end 81 and a lower end 82. The lower end 82 of the upper carriage 80 is secured to the lower carriage 50 by a bolt 83. The upper carriage 80 includes an upper shaft support 84 adjacent the upper end 81 thereof. The upper shaft support 84 has a hole 85 therethrough. As such, the upper end 71 of the shaft 70 fits through the hole 85 in the upper shaft support 84.

The upper carriage 80 also includes a pair of blade stop arms 86 projecting therefrom intermediate the upper end 81 and the lower end 82 thereof. The blade stop arms 86 limit pivotal movement of the snowplow blade 60 on the shaft 70 relative to the upper carriage 80 and the lower carriage 50. Accordingly, each of the blade stop arms 86 abut the rear face 62 of the snowplow blade 60 when the snowplow blade 60 is pivoted. As such, one of the blade stop arms 86 abuts a right-half of the snowplow blade 60 and the other blade stop arm 86 abuts a left-half of the snowplow blade 60. In an illustrative embodiment, the blade stop arms 86 limit pivotal movement of the snowplow blade 60 to about 30 degrees.

A stop pad 87 is provided at the upper end 81 of the upper carriage 80. The stop pad 87 prevents the upper end 81 of the upper carriage 80 from abutting the mounting frame 40 and the elongated member 20 of the vehicle mount 12.

In the preferred embodiment, the snowplow blade 60 is adjustably coupled to the upper carriage 80 and the lower carriage 70. Accordingly, the snowplow blade 60 is raised and lowered relative to the upper carriage 80 and the lower carriage 70 by rotating the shaft 70 counterclockwise and clockwise, respectively. The shaft 70 includes a hexagonal-shaped portion 76 at the upper end 71 thereof. The hexagonal-shaped portion 76 is adapted for receiving a wrench for use in rotating the shaft 70. In an illustrative embodiment, the snowplow blade 60 has approximately 3 inches of travel. Accordingly, the snowplow blade 60 may be adjusted from ground level to about 3 inches above ground level. Ideally, the snowplow blade 60 is positioned about 1 to 1½ inches above ground level while in use.

A compressible support means 90 is provided for maintaining the snowplow blade 60 generally in the lowered, operative position and for allowing rearward movement of the snowplow blade 60. The compressible support means comprises 90 a pair of guide rods 91 angularly projecting from the mounting frame 40, and a pair of springs 94 disposed around the pair of guide rods 91 wherein one of the springs 94 is disposed around one of the guide rods 91.

Each of the guide rods 91 has a first end 92 and a second end 93. The first end 92 of each guide rod 91 is secured to the mounting plate 47 of the mounting frame 40 and the second end 93 of each guide rod 91 is extendable through the slot 54 in one of the spaced legs 53 of the lower carriage 50. Accordingly, the springs 94 are interposed between the mounting plate 47 and one of the spaced legs 53. Each of the springs 94 are demountably secured to one of the guide rods 91 at the first end 92 thereof. In the preferred embodiment, a retaining spring (not shown) is used to retain the springs 94 on the guide rods 91. As such, the retaining spring is joined at each end to one of the springs 94 and is positioned behind the first end 45 of the lower plate 44 of the mounting frame 40.

Accordingly, the snowplow blade 60 is rearwardly pivotable wherein the second end 93 of each guide rod 91 increasingly extends through the slot 54 in each of the spaced legs 53 as the lower carriage 50 pivots rearwardly towards the mounting frame 40. However, each of the springs 94 resist compression so as to bias the snowplow blade 60 to the lowered, operative position. As such, when a substantially rigid obstacle is encountered by the snowplow blade 60, the compressible support means 90 allows for sufficient rearward movement of the snowplow blade 60 so as to allow the obstacle to pass thereunder.

As best illustrated in FIG. 6, the snowplow blade 60 is pivotable between a raised, stowed position, a lowered, operative position, and a forward position. To pivot the snowplow blade 60 to the raised, stowed position, the pair of springs 94 must be removed from the pair of guide rods 91. As such, the snowplow blade 60 may be pivoted rearwardly to the raised, stowed position wherein the second end 93 of each guide rod 91 is extended through the slot 54 in each of the spaced legs 53 as the lower carriage 50 is pivoted rearwardly.

A U-shaped pin 104 is provided for retaining the snowplow blade 60 in the raised, stowed position. The U-shaped pin 104 has a first leg and a second. Accordingly, the U-shaped pin 104 is horizontally inserted in association with the mounting frame 40 and the lower carriage 50 so as to retain the snowplow blade 60 in a generally horizontal position. As such, the first leg rests on the lower plate 44 of the mounting frame 40 and the second leg holds the lower end 52 of the lower carriage 50.

In addition, an elastic strap 106 may be provided for urging the snowplow blade 60 to the lowered, operative position from the forward position. Accordingly, the elastic strap 106 is looped around the lower plate 44 of the mounting frame 40 (behind the U-bolts 49 securing the mounting frame 40 to the elongated member 20) and the ends of the elastic strap 106 are joined to the upper carriage 50.

In use, the vehicle mount 12 is mounted to the front of the vehicle 2. Preferably, the mounting brackets 30 are mounted to the frame or the bumper mounts of the vehicle 2. Thereafter, each of the snow deflector assemblies 14 are mounted to the elongated member 20 of the vehicle mount 12. A first of the snow deflector assemblies 14 is removably mounted to the elongated member 20 adjacent the first end 21 thereof and a second of the snow deflector assemblies 14 is removably mounted to the elongated member 20 adjacent the second end 22 thereof such that the snow deflector assemblies 14 are mounted ahead of and in line with the front wheels of the vehicle 2. Ideally, the snowplow blade 60 is positioned about 1 to 1½ inches above the ground by rotating the shaft 70 counterclockwise or clockwise, as necessary.

When not in use, the snow deflector assemblies 14 are pivoted to the raised, stowed position. To do so, the pair of springs 94 are removed from the pair of guide rods 91. Thereafter, the snowplow blade 60 may be pivoted rearwardly to the raised, stowed position wherein the second end 93 of each guide rod 91 extends through the slot 54 in each of the spaced legs 53 as the lower carriage 50 is pivoted rearwardly. Accordingly, the U-shaped pin 104 is horizontally inserted in association with the mounting frame 40 and the lower carriage 50 so as to retain the snowplow blade 60 in the raised, stowed position. As such, the first leg of the U-shaped pin 104 rests on the lower plate 44 of the mounting frame 40 and the second leg of the U-shaped pin 104 holds the lower end 52 of the lower carriage 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A snow plowing system mountable to the front of a vehicle, comprising:

a pair of snow deflector assemblies, each of said pair of snow deflector assemblies mounted ahead of and in line with a front wheel of said vehicle;

a vehicle mounting means for mounting each of said pair of snow deflector assemblies to said vehicle;

wherein each of said pair of snow deflector assemblies comprises a snow deflector mounting means for mounting said snow deflector assembly to said vehicle mounting means, a lower carriage coupled to said snow deflector mounting means, and a snowplow blade coupled to said lower carriage;

wherein said snowplow blade is moveable between a lowered, operative position and a raised, stowed position;

wherein each of said pair of snow deflector assemblies further comprises a compressible support means for maintaining said snowplow blade generally in said lowered, operative position and for allowing rearward movement of said snowplow blade;

wherein said snow deflector mounting means comprises a mounting frame, wherein said lower carriage has a lower end, said lower carriage including a pair of spaced legs extending from said lower end thereof, each of said pair of spaced legs having a slot therein, and wherein said compressible support means comprises:

a pair of guide rods angularly projecting from said mounting frame, each of said pair of guide rods having a first end and a second end, said first end of each of said pair of guide rods secured to said mounting frame, said second end of each of said pair of guide rods extendable through said slot in one of said pair of spaced legs of said lower carriage, and a pair of springs disposed around said pair of guide rods, one of said pair springs disposed around one of said pair of guide rods, each of said pair of springs interposed between said mounting frame and one of said pair of spaced legs of said lower carriage.

2. A snow plowing system mountable to the front of a vehicle, comprising:

a vehicle mount removably mounted to the front of said vehicle;

a pair of snow deflector assemblies each removably mounted to said vehicle mount, each of said pair of snow deflector assemblies mounted ahead of and in line with a front wheel of said vehicle;

wherein each of said pair of snow deflector assemblies are independently moveable between a lowered, operative position and a raised, stowed position;

wherein each of said pair of snow deflector assemblies comprises a mounting frame removably secured to said vehicle mount, a lower carriage pivotally coupled to said mounting frame, and a snowplow blade pivotally and adjustably coupled to said lower carriage;

wherein each of said pair of snow deflector assemblies further comprises a compressible support means for maintaining said snowplow blade generally in said lowered operative position and for allowing rearward movement of said snowplow blade; and wherein said lower carriage has a lower end, said lower carriage including a pair of spaced legs extending from said lower end thereof, each of said pair of spaced legs having a slot therein, and wherein said compressible support means comprises:

a pair of guide rods angularly projecting from said mounting frame, each of said pair of guide rods having a first end and a second end, said first end of each of said pair of guide rods secured to said mounting frame, said second end of each of said pair of guide rods extendable through said slot in one of said pair of spaced legs of said lower carriage, and a pair of springs disposed around said pair of guide rods, one of said pair springs disposed around one of said pair of guide rods, each of said pair of springs interposed between said mounting frame and one of said pair of spaced legs of said lower carriage.

3. The snow plowing system of claim 1, wherein said pair of springs are demountably coupled to said pair of guide rods.

4. The snow plowing system of claim 2, further comprising:

a retention means for retaining said snowplow blade in said raised, stowed position.

5. The snow plowing system of claim 4, wherein said retention means comprises:

a U-shaped pin insertable in association with said mounting frame and said lower carriage so as to retain said snowplow blade in said raised, stowed position.

6. The snow plowing system of claim 2, wherein said mounting frame comprises:

an upper plate, and a lower plate, said upper plate and said lower plate each having a first end and a second end, said upper plate and said lower plate joined at said first ends thereof, said upper plate diverging from said lower plate towards said second end of said upper plate, said vehicle mount positionable between said upper plate and said lower plate.

7. The snow plowing system of claim 2, wherein said snowplow blade is generally V-shaped.

8. The snow plowing system of claim 2, wherein said snowplow blade includes a rubber pad along a lower edge thereof.

9. A snow plowing system mountable to the front of a vehicle, comprising:

a vehicle mount removably mounted to the front of said vehicle;

a pair of snow deflector assemblies each removably mounted to said vehicle mount, each of said pair of snow deflector assemblies mounted ahead of and in line with a front wheel of said vehicle;

wherein each of said pair of snow deflector assemblies are independently moveable between a lowered operative position and a raised, stowed position;

wherein each of said pair of snow deflector assemblies comprises a mounting frame removably secured to said vehicle mount, a lower carriage pivotally coupled to said mounting frame, and a snowplow blade pivotally and adjustably coupled to said lower carriage;

wherein said snowplow blade includes a sleeve secured to a rear face thereof; and wherein said lower carriage includes an arm extending outward therefrom and includes a lower sleeve at an outermost end of said arm, said lower sleeve being vertically oriented and including internal threads, and wherein each of said pair of snow deflector assemblies further comprises:

a shaft pivotally coupling said snowplow blade to said lower carriage, said shaft having an upper end and a lower end, said shaft including external threads adjacent said lower end thereof, said upper end of said shaft inserted through said sleeve of said snowplow blade and said lower end of said shaft threadingly inserted into said lower sleeve of said lower carriage.

10. The snow plowing system of claim 9, wherein each of said pair of snow deflector assemblies further comprises:

an upper carriage secured to said lower carriage, said upper carriage having an upper end, said upper carriage including an upper shaft support adjacent said upper end thereof, said upper shaft support having a hole therethrough, and wherein said upper end of said shaft is slidably fitted through said hole in said upper shaft support.

11. The snow plowing system of claim 10, wherein said upper carriage includes a pair of blade stop arms projecting therefrom, said pair of blade stop arms limiting pivotal movement of said snowplow blade on said shaft relative to said upper carriage and said lower carriage.

12. The snow plowing system of claim 9, wherein said mounting frame comprises:

an upper plate, and a lower plate, said upper plate and said lower plate each having a first end and a second end, said upper plate and said lower plate joined at said first ends thereof, said upper plate diverging from said lower plate towards said second end of said upper plate, said vehicle mount positionable between said upper plate and said lower plate.

13. The snow plowing system of claim 9, wherein said snowplow blade is generally V-shaped.

14. The snow plowing system of claim 9, wherein said snowplow blade includes a rubber pad along a lower edge thereof.

15. The snow plowing system of claim 9, wherein each of said pair of snow deflector assemblies further comprises:

a compressible support means for maintaining said snowplow blade generally in said lowered, operative position and for allowing rearward movement of said snowplow blade.

16. The snow plowing system of claim 9, further comprising:

a retention means for retaining said snowplow blade in said raised, stowed position.

17. The snow plowing system of claim 9, wherein said retention means comprises:

a U-shaped pin insertable in association with said mounting frame and said lower carriage so as to retain said snowplow blade in said raised, stowed position.

18. The snow plowing system of claim 9, wherein each of said pair of snow deflector assemblies further comprises:

a compressible support means for maintaining said snowplow blade generally in said lowered, operative position and for allowing rearward movement of said snowplow blade.

* * * * *